United States Patent [19]

Chiaves

[11] Patent Number: 4,659,261

[45] Date of Patent: Apr. 21, 1987

[54] RETAINING WALL FOR EARTH AND SIMILAR MATERIALS

[75] Inventor: Carlo Chiaves, Turin, Italy

[73] Assignee: Wall Patent S.A., Italy

[21] Appl. No.: 625,164

[22] Filed: Jun. 27, 1984

[30] Foreign Application Priority Data

Jul. 7, 1983 [IT] Italy ..... 67738 A/83

[51] Int. Cl.[4] ..... E02D 29/02

[52] U.S. Cl. ..... 405/286; 405/287

[58] Field of Search ..... 405/262, 284, 285, 286, 405/287

[56] References Cited

U.S. PATENT DOCUMENTS

| | | | |
|---|---|---|---|
| 1,360,767 | 11/1920 | Lacaze | 405/286 |
| 1,637,065 | 7/1927 | Traylor et al. | 405/285 |
| 1,812,364 | 6/1931 | Oursler | 405/287 |
| 3,195,312 | 7/1965 | Rumsey | 405/287 |
| 3,977,199 | 8/1976 | Chiaves | 405/287 |
| 4,126,001 | 11/1978 | Shimada et al. | 405/287 |

*Primary Examiner*—David H. Corbin

*Attorney, Agent, or Firm*—Sughrue, Mion, Zinn, Macpeak, and Seas

[57] ABSTRACT

A retaining wall for earth and similar material has its front face formed by a series of prefabricated reinforced-concrete panels. In use, the prefabricated panels are arranged vertically in side-by-side relation and rest on a concrete footing cast in situ. The prefabricated panels are rigidly connected to a concrete anchor bed cast during the course of construction and which extends away from the prefabricated panels towards the earth to be retained. The said concrete anchoring bed is disposed at a level higher than the base of said panels and is spaced from the latter by a distance of between 1/5 and ½ of the total height of the said panels.

5 Claims, 5 Drawing Figures

RETAINING WALL FOR EARTH AND SIMILAR MATERIALS

FIELD OF THE INVENTION

The invention relates to retaining walls for earth and similar material, which comprise a series of prefabricated reinforced concrete panels arranged vertically, in side-by-side relation, on a concrete footing cast in situ and rigidly connected to a concrete anchoring bed cast during the construction process and extending towards the earth to be retained.

DESCRIPTION OF THE PRIOR ART

Examples of walls formed by prefabricated panels and concrete anchoring and/or foundation beds cast in situ are those described in U.S. Pat. Nos. 3,426,541; 4,000,622; and 3,977,199 all issued to the present applicant.

Retaining walls of this type find a characteristic and particularly exacting field of application as supports for causeways and embankments, but are rarely used as shoring walls, that is, as retaining walls for the exposed fronts of excavations between slopes which may occasionally be very steep.

In such cases when walls of this type are used, it is necessary to overcome various problems which present themselves either during installation of the said walls or subsequently, that is, when the walls are operative. During the installation, a considerable problem arises due to the need to prevent the excavation made in the slope for the purpose of locating the wall in the latter, from constituting a danger to those employed in installing the wall itself. A further problem which presents itself when the wall has been built is that of resisting the overturning action produced by the thrust of the earth.

Both these problems make it necessary to limit the useful height of the prefabricated panels and, therefore, the useful height achievable for the wall. For this reason the field of application of the walls of the type remains limited.

The object of the present invention is to provide a wall of the type specified above, for retaining earth and similar material, which makes it possible to achieve greater heights than those possible until now, or which, for the same height of wall, is easier to install, safer and more economic.

SUMMARY OF THE INVENTION

According to the present invention this object is achieved with a wall of the said type for retaining earth and similar material, the characteristic of which lies in the fact that the concrete bed for anchoring the prefabricated panels is situated at a level which is higher than the base of the said panels and is at a distance D from the latter of between 1/5 and ½ of the total height of the said panels.

The raised position of the concrete anchoring bed with respect to the base of the panels makes it possible to construct the retaining wall with excavation divided between two lines in such a manner as to provide a support base for the bed at the level of the latter.

Since with this arrangement each prefabricated panel is effectively hinged to the footing rather than being embedded in the latter or in the concrete stabilisation bed, the lower part of the excavation is much nearer to the base of the panel, it only being necessary to leave a space behind the panel equal to the thickness required for a hinged section, rather than to the entire width that it is necessary to allow for the concrete bed for stablility of the construction, or at least to the thickness required for a section embedded on the foundation.

Since, while retaining the same degree of safety of the finished work, it is not the upper part of the excavation which has to be transferred upwards to form the bearing base for the raised bed, but rather it is the lower part that is transferred downwards, it follows that there is considerable reduction in the volume requiring to be excavated and, most importantly, that the resultant excavation profile is much more stable.

In this way, there is less risk to those involved in installing the wall.

According to a preferred form of embodiment of the present invention, the said retaining wall is further characterised in that, in use, the prefabricated panels are inclined towards the earth to be retained at an angle of between 5 and 20 degrees with respect to the vertical.

As a result of this inclination, the weight of the earth which rests on the concrete anchoring bed produces a stabilising moment against the outward thrust, the size of this moment, other factors being equal, being the greater due to the increase in distance between the vertical line of action of this weight and the base axis of the panel about which the thrust acts.

Furthermore, the inclination of the panel makes it possible to completely counterbalance the thrust of the earth below the level of the concrete anchoring bed during installation of a said panel and before the casting of the concrete anchoring bed. The wall may therefore be back filled with earth as far as the level of the concrete bed immediately after the placing of the prefabricated panels, without waiting for periods of setting or seasoning of any concrete casting, with greater safety and speed.

Finally, this arrangement makes it possible to fully exploit, in aid of the stability of the construction, the cohesion of the soil below the raised concrete bed-cohesion which is very frequently found in practice, when retaining an existing bank—which can play a useful and important role in the stability of the construction, but which is destroyed during construction using known techniques due to the depth of excavation.

BRIEF DESCRIPTION OF THE DRAWINGS

The invention will now be described with reference to a preferred embodiment illustrated in the attached drawings, which are supplied by way of non-limiting example in which.

DESCRIPTION OF THE REFERRED EMBODIMENTS

Figure 1:
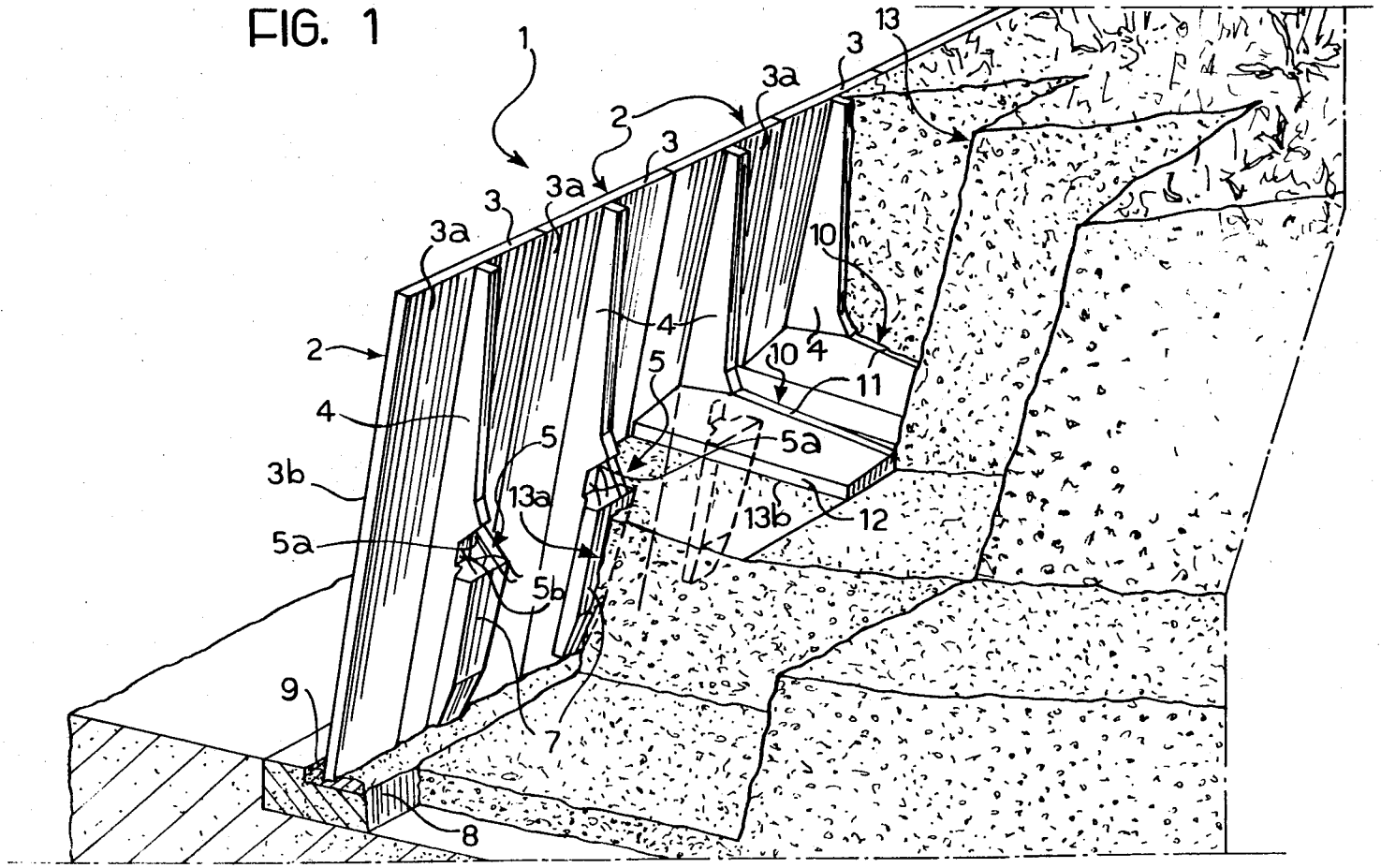
FIG. 1 is a partially sectioned perspective view of a retaining wall according to the invention.
Figure 2:
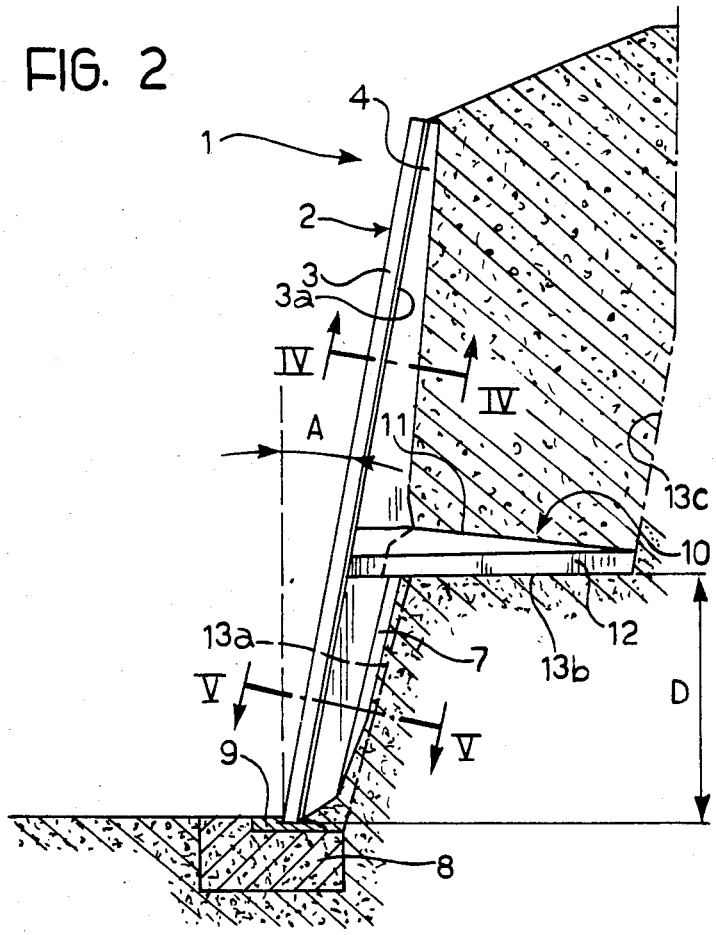
FIG. 2 is a sectional view taken on line II—II of FIG. 1.
Figure 3:
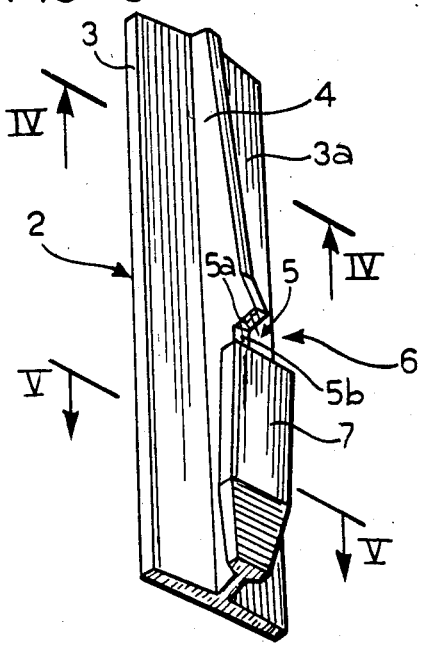
FIG. 3 is a perspective view of a prefabricated panel of the retaining wall of FIG. 1.
Figure 4:
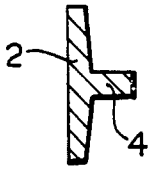
FIG. 4 is a partial sectional view taken on line IV—IV of FIG. 3.
Figure 5:
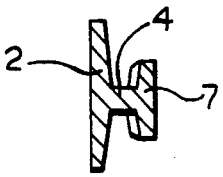
FIG. 5 is a partial sectional view taken on line V—V of FIG. 2.

Reference 1 indicates in its entirety an earth retaining wall. The wall 1 is formed by a plurality of prefabricated panels 2 arranged vertically next to each other in elevation. Each panel 2 comprises a support plate 3 provided on its surface 3*a* facing the earth to be retained with a longitudinal rib 4 extending over the full height of the panel 2. The rib 4 is provided in an intermediate position with an aperture forming a recess 5. The recess 5 is delimited by faces 5*a* from which protrude a plurality of metal reinforcement rods 6. The part of the rib 4 lying between the recess 5 and the base of the panel 2 is provided with an enlarged portion 7 facing the earth to be retained. The cross-sectional form of the rib in its part provided with the enlarged portion 7 is substantially T shaped. The prefabricated panels rest on a concrete footing 8 which has been cast in-situ and forms the bearing base of the wall 1. The bottom end of the panels 2 is connected to the concrete footing 8 by a thin layer of concrete 9 cast in situ. The recess 5 of each panel 2 is rigidly connected to a concrete bed 10 which has been cast in situ. The bed 10 comprises a base plate 12 and a plurality of protruding ribs 11. The distance D between the bed and the bottom of the panel is between 1/5 and ½ of the total height of the said panel. Each rib extends up to the faces 5*a* which delimit the recess 5 of the corresponding panel 2. In this way the reinforcement rods 6 of the panels 2 are incorporated within the anchoring bed 10.

The lines 13*a*, 13*b*, and 13*c* indicate the profile of the ground excavation carried out in order to enable the installation of the wall 1. This installation is effected in the following way. In a first phase, the concrete footing 8 is cast in a corresponding trench. When this concrete footing has set sufficiently, the panels 2 are placed in position on the girder in side-by-side relation to each other. In one preferred practical embodiment illustrated in FIG. 1, these panels are arranged inclined with respect to the vertical by an angle A of between 5 and 20 degrees. The angle A is such that the panels are inclined towards the earth to be retained. In this position the panels 2 are supported by braces or struts which prevent them from overturning. The layer of concrete 9 is then cast, the main function of which is to effect a sealing action between the base of the panels 2 and the concrete foundation girder 8. The ground excavation presents less of a danger to those involved in installing the panels 2 due to its interrupted form in the region of the section 13*b*, intended to form the base on which the concrete anchoring bed is to rest. The panels are designed to permit filling in of the hollow that exists between the section 13*a* of the excavation 13*a* and the adjacent facing side of the panels 2. The thrust of the earth, placed in this hollow is such that it counterbalances the overturning tendency of the panels 2, and it is therefore possible at this stage to completely remove the braces supporting the said panels. The horizontally disposed concrete anchoring bed 12 is then cast such as to incorporate the reinforcement rods 6 of the panels 2 and form a single rigid structure with the latter. Finally, the hollow comprised between the excavation line 13*c* and the facing side 3*a* of the panels 2 is subsequently filled in.

Naturally, without prejudice to the principle of the invention, the forms of practical realisation and the particulars of embodiment may be extensively varied without thereby departing from the scope of the present invention.

I claim:

1. A retaining wall for earth and similar material, said wall comprising a concrete footing girder, a series of prefabricated reinforced concrete panels arranged substantially vertically in side-by-side relation on said concrete footing girder for pivotal movement relative to said girder, and a concrete anchoring bed cast in situ and extending horizontally towards the earth to be supported, said anchoring bed being rigidly connected to said panels; wherein said concrete anchoring bed is situated at a level which is at a distance above the bottom of said panels of between 1/5 and ½ of the total height of said panels.

2. A wall according to claim 1, wherein, in use, the said prefabricated panels are inclined with respect to the vertical towards the earth to be retained, at an angle of between 5 and 20 degrees.

3. A wall according to claim 1 wherein each of said panels is provided with metal reinforcement rods which protrude from a part of each panel to which said concrete anchoring bed is connected, said reinforcement rods being incorporated within said concrete bed when said bed is cast.

4. A wall according to claim 1 wherein each of said panels is provided on its side facing towards the earth to be retained with at least one longitudinal rib extending from top to bottom of each panel, said rib being provided with reinforcement rods which protrude from said rib for incorporation within the said concrete bed when said bed is cast.

5. A wall according to claim 4 wherein in each panel the part of said longitudinal rib lying between the section that is to be connected to said concrete anchoring bed and the bottom of said panel has a T-shaped transverse section.

* * * * *